US005969707A

United States Patent [19]

Hsu

[11] Patent Number: 5,969,707

[45] **Date of Patent: *Oct. 19, 1999**

[54] APPARATUS AND METHOD OF MOSAIC PICTURE PROCESSING

[75] Inventor: Jerry Hsu, Tainan, Taiwan

[73] Assignee: United Microelectrics Corp., Hsinchu, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 08/863,104

[22] Filed: May 23, 1997

Related U.S. Application Data

[62] Division of application No. 08/700,807, Aug. 21, 1996, abandoned.

[51] Int. Cl.[6] ..... G09G 5/36

[52] U.S. Cl. ..... 345/133; 345/509

[58] Field of Search ..... 345/113, 114, 345/121, 127, 128, 133, 141, 192, 193, 513, 515, 516, 517, 509, 186, 188, 510; 348/578

[56] References Cited

U.S. PATENT DOCUMENTS

| | | | |
|---|---|---|---|
| 4,217,577 | 8/1980 | Roe et al. | 340/703 |
| 4,267,573 | 5/1981 | Chaikin et al. | 340/727 |
| 4,888,643 | 12/1989 | Kusakabe | 348/578 |
| 4,906,985 | 3/1990 | Furlong | 345/197 |
| 4,941,110 | 7/1990 | Bassman | 345/189 |
| 4,951,038 | 8/1990 | Yamamura et al. | 345/133 |
| 5,163,024 | 11/1992 | Heilveil | 345/190 |
| 5,227,863 | 7/1993 | Bilbrey et al. | 395/133 |
| 5,400,052 | 3/1995 | Otake et al. | 345/127 |
| 5,416,499 | 5/1995 | Ohtsu | 345/190 |
| 5,592,609 | 1/1997 | Suzuki et al. | 395/133 |
| 5,608,424 | 3/1997 | Takahashi et al. | 345/185 |

*Primary Examiner*—Regina Liang

[57] ABSTRACT

A mosaic picture processing apparatus and method is disclosed. The present invention includes a memory device for storing picture data, which include index data, pattern data, and pattern control data. A pattern coordinate generating device is used for generating a horizontal coordinate and a vertical coordinate. A mosaic device is used for generating a mosaic control signal. Next, the index data is read from the memory device in response to the horizontal coordinate, the vertical coordinate, and the mosaic control signal. Further, the pattern data is read from the memory device in response to the horizontal coordinate, the vertical coordinate, the index data, and the mosaic control signal.

24 Claims, 26 Drawing Sheets

ø 1:reading PNT
ø 3:reading PGT

| | P0 | P1 | P2 | P3 | P4 | P5 | P5 | P7 |
|---|---|---|---|---|---|---|---|---|
| ø 1 | | | | | | | | |
| ø 3 | BMP | BMP | BMP | BMP | BMP | BMP | BMP | BMP |

FIG. 1A(Prior Art)

| | P0 | P1 | P2 | P3 | P4 | P5 | P5 | P7 |
|---|---|---|---|---|---|---|---|---|
| ø 1 | PNT | PNT | PNT | PNT | PNT | PNT | PNT | PNT |
| ø 3 | PGT | PGT | PGT | PGT | PGT | PGT | PGT | PGT |

FIG. 1B(Prior Art)

| | a | b | c | d |
|---|---|---|---|---|
| a | aa | ba | ca | da |
| b | ab | bb | cb | db |
| c | ac | bc | cc | dc |
| d | ad | bd | cd | dd |

| | | | |
|---|---|---|---|
| bb | bb | db | db |
| bb | bb | db | db |
| bd | bd | dd | dd |
| bd | bd | dd | dd |

FIG. 10C

| | P0 | P1 | P2 | P3 | P4 | P5 | P5 | P7 |
|---|---|---|---|---|---|---|---|---|
| ø2 | PNT1 | PNT1 | PNT2 | PNT2 | PNT3 | PNT3 | PNT4 | PNT4 |

FIG. 13A

| | P0 | P1 | P2 | P3 | P4 | P5 | P5 | P7 |
|---|---|---|---|---|---|---|---|---|
| ø2 | PNT1 | PNT1 | PNT1 | PNT2 | PNT2 | PNT2 | PNT3 | PNT3 |

FIG. 13B

| | | | | | | | | |
|---|---|---|---|---|---|---|---|---|
| | P0 | P1 | P2 | P3 | P4 | P5 | P5 | P7 |
| ø2 | PNT1 | PNT1 | PNT1 | PNT1 | PNT1 | PNT2 | PNT2 | PNT2 |

FIG. 13C

APPARATUS AND METHOD OF MOSAIC PICTURE PROCESSING

This is a Divisional of application Ser. No. 08/700,807, filed Aug. 21, 1996, now abandoned, which application(s) are incorporated herein by reference.

BACKGROUND OF THE INVENTION

1. Field of the Invention

The present invention relates to a method and apparatus of mosaic picture processing, and particularly to a method and apparatus of mosaic picture processing using an image cell as a processing unit.

2. Description of the Prior Art

One of two main conventional picture processing systems is called a frame buffer, which maps each pixel on a screen to some bits of a memory buffer. As shown in the timing allocation diagram of FIG. 1A, only one pixel is read in a time interval using the frame buffer scheme for a 16 bit system. The bandwidth usage is only 50% for processing a picture of 256 colors or 8 bits. Moreover, the bandwidth usage is 25% for processing a picture of 16 colors or 4 bits. The other situations are further listed in Table 1.

TABLE 1

| | | | | |
|---|---|---|---|---|
| number of colors | 256 | 16 | 4 | 2 |
| depth | 8 | 4 | 2 | 1 |
| bandwidth usage | 50% | 25% | 12.5% | 6.25% |

Owing to the structural simplicity, this frame buffer scheme can be easily constructed, but requires a lot of memory space. For example, 64K bytes memory is needed for a screen having 256 colors and 256×256 pixels. Further, these 64K bytes are moved whenever the picture on the screen is updated, consequently slowing down the whole picture processing system.

Another kind of the conventional picture processing systems is a system which uses an image cell in order to save memory space and accelerate the process. The primary advantage of using the image cell is that a pattern defined by the image cell can be repeatedly retrieved, greatly saving the memory space. An address of an image cell is initially generated to obtain an index stored in a pattern name table (PNT), followed by acquiring a pattern data stored in a pattern generation table (PGT) according to the previously obtained index. As the contents of different image cells on the screen are usually the same, and therefore occupy only one block of memory instead of two as in the frame buffer method. More data and attributes such as horizontal mirror data, vertical mirror data and palette are also stored in the PNT in addition to the aforementioned index.

The relationship between the PNT and the PGTs is illustrated in FIGS. 2A to 2E, where an 8×8 image cell is used. The color mode of 2 colors, 4 colors, 16 colors and 256 colors are represented by FIG. 2B, FIG. 2C, FIG. 2D and FIG. 2E respectively with depth of 1, 2, 4 and 8. The relationship among the depth, the number of colors and the required memory is further listed in Table 2, where the relationship between the depth and the number of the colors is: number of colors=$2^{depth}$. For example, there are 256 or $2^8$ colors available for a depth of 8. Also, the relationship between the required memory and the depth is: required memory=8×8×depth/8 bytes. For example, 64 (or 8×8×8 8) bytes are required for a depth of 8.

TABLE 2

| depth | number of colors | memory (byte) |
|---|---|---|
| 1 | 2 | 8 |
| 2 | 4 | 16 |
| 4 | 16 | 32 |
| 8 | 256 | 64 |

FIG. 1B shows the timing diagram of a traditional picture processing system using the image cell, where the index of the PNT is firstly read, and then the PGT data is read. The bandwidth usage of PNT is only 12.5% owing to the fact that the same PNT data of neighboring eight pixels are repeatedly read.

A mosaic picture processing is commonly required in a picture processing system such as a video game, making an image vague purposely or a smooth transition between two images. For example, the picture in FIG. 3A is processed by a mosaic picture processing to produce the picture as shown in FIG. 3B.

SUMMARY OF THE INVENTION

A mosaic picture processing apparatus and method is disclosed, wherein an image cell is used as a processing unit. The present invention includes a memory device for storing picture data, which include index data, pattern data, and pattern control data. A pattern coordinate generating device is used for generating a horizontal coordinate and a vertical coordinate. A mosaic register is used for generating a mosaic control signal, which is written by a CPU. Next, the index data is read from the memory device responsive to the horizontal coordinate, the vertical coordinate, and the mosaic control signal. Further, the pattern data is read from the memory device responsive to the horizontal coordinate, the vertical coordinate, the index data, and the mosaic control signal. Next, the pattern data of an image cell is output and the pattern data of the image cell are stored in an image cell buffer. Output data are serially generated by a shift register responsive to the pattern data of the image cell of the image cell buffer. Finally, a position of the output data is selected by a selector.

BRIEF DESCRIPTION OF THE DRAWINGS

FIG. 1A illustrates a timing allocation diagram for traditionally reading bit-mapped data.

FIG. 1B illustrates a timing allocation diagram for traditionally reading an image cell.

FIG. 10C shows another mapping example with a mosaic size of2×2.

FIG. 13A is the timing diagram for a 4-4-4-4 mode.

FIG. 13B is the timing diagram for a 16-16-4 mode.

FIG. 13C is the timing diagram for a 256-16 mode.

DESCRIPTION OF THE PREFERRED EMBODIMENT

Figure 2A:
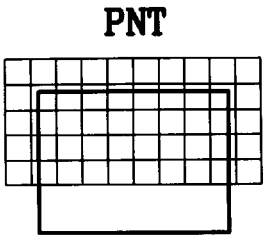
FIG.2A (Prior Art)
FIGS. 2A to 2E show the relationship between a pattern name table (PNT) and a pattern generation table (PGT).
Figure 2B:
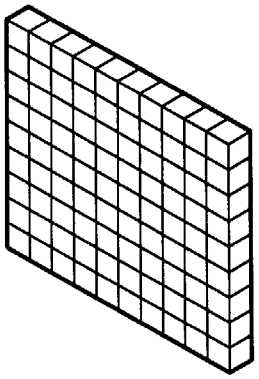
FIG.2B (Prior Art)
Figure 2C:
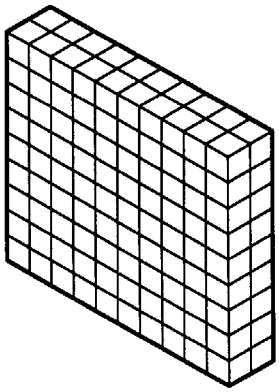
FIG.2C (Prior Art)
Figure 2D:
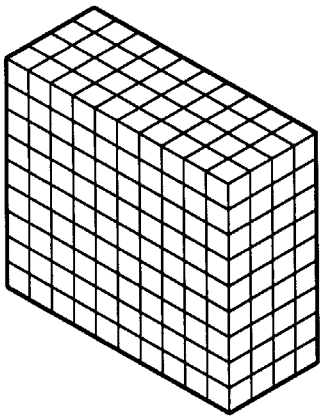
FIG.2D (Prior Art)
Figure 2E:
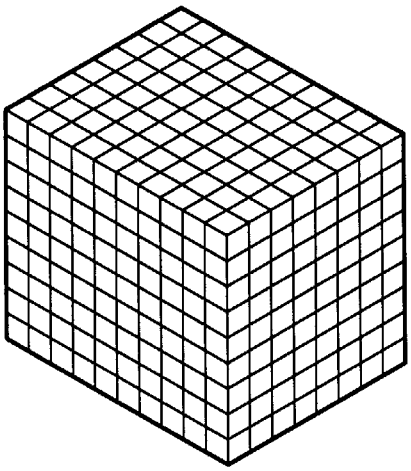
FIG.2E (Prior Art)
Figure 3A:
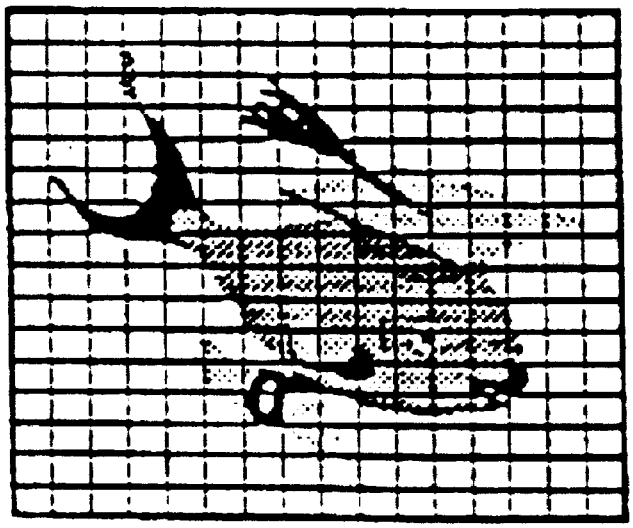
FIG.3A (Prior Art)
FIG. 3A shows an original image.
Figure 3B:
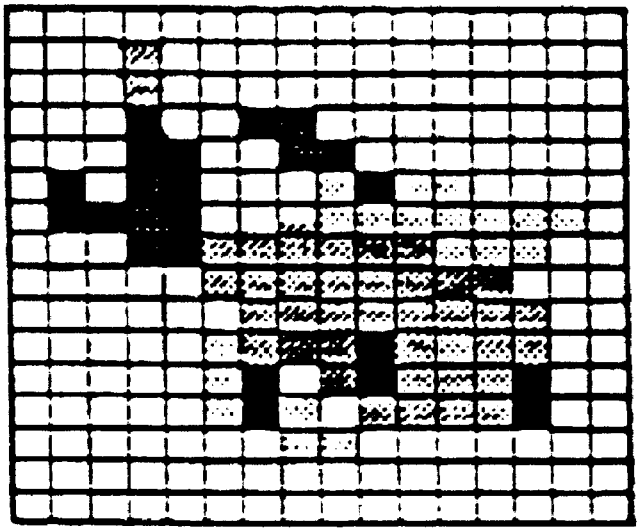
FIG.3B (Prior Art)
FIG. 3B shows a processed image of FIG. 3A after applying a mosaic processing.
Figure 4:
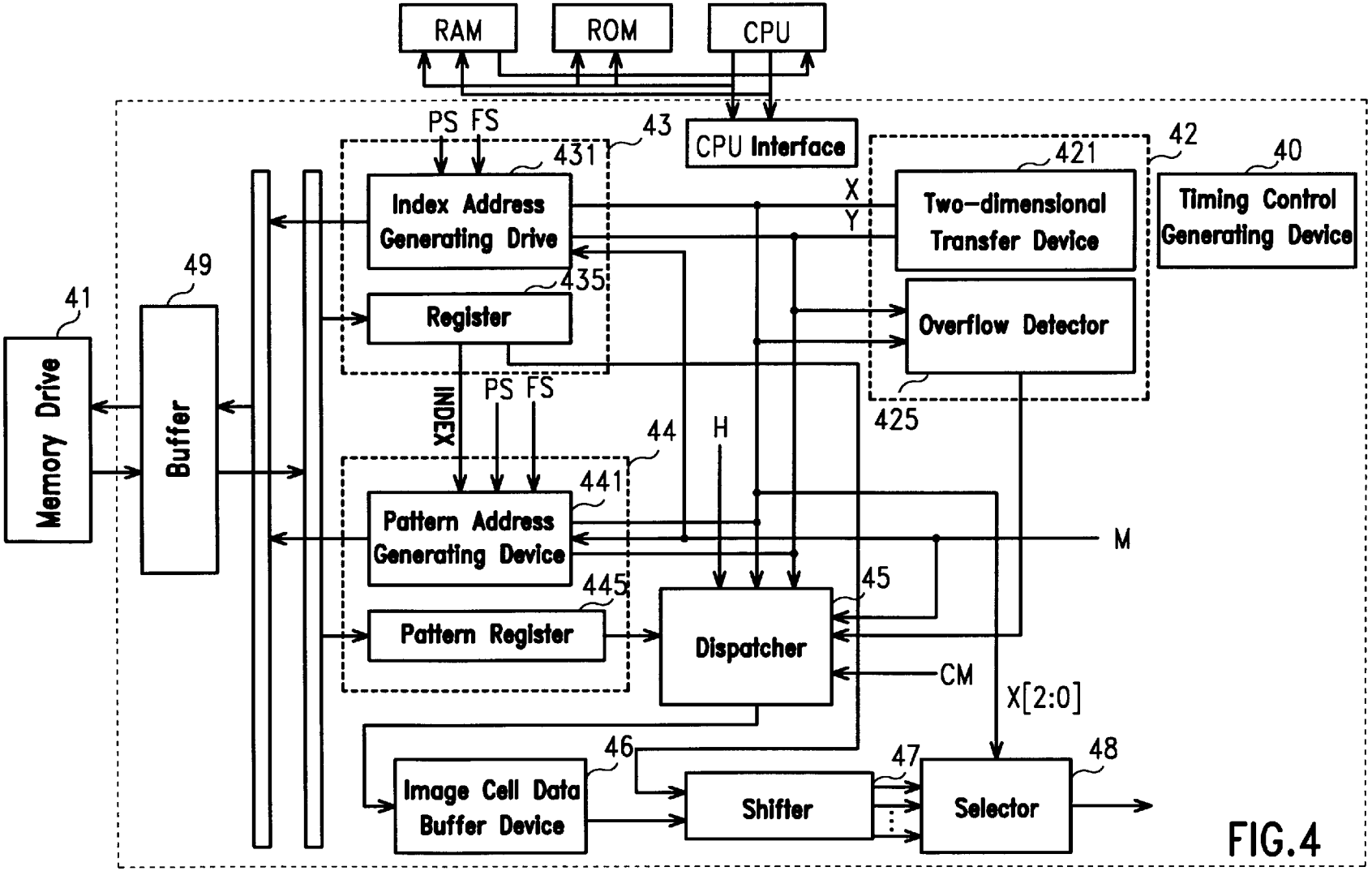
FIG. 4 shows the block diagram of the present invention.

FIG. 4 shows the block diagram of the present invention, which includes a memory device 41 for storing picture data such as index data, pattern data, and pattern control data. A pattern coordinate generating device 42 is used for generating a horizontal coordinate and a vertical coordinate of pattern An index reading device 43 responsive to the horizontal coordinate X, the vertical coordinate Y, and a mosaic control signal M is used for reading the pattern name table (PNT) data, such as the index data, from the memory device 41. A pattern reading device 44 responsive to the horizontal coordinate X, the vertical coordinate Y, the index data, and the mosaic control signal M is then used for reading the pattern data from the memory device 41. A pattern dispatch device 45 outputs the pattern data of an image cell, and an image cell buffer 46 stores the pattern data of the image cell. A shift register 47 responsive to the pattern data of the image cell of the image cell buffer 46 is used for serially generating some output data. A selecting device 48 is used for selecting a position of the output data, achieving a horizontal shift effect. The timing of the whole system is supported by a timing control device 40. All blocks mentioned above will be discussed in the following paragraphs, and a 16 bit system using a 8×8 image cell scheme is assumed except otherwise stated.

The memory device 41, such as a static random access memory (SRAM) is initially configured, and the picture data stored in a game cartridge are input to the memory device 41. The picture data usually contain the index data of the PNT, the pattern data of a pattern generation table (PGT), a horizontal offset and a vertical offset.

A screen coordinate (h, v) is consequently transferred to a pattern coordinate (x, y) by a pattern coordinate generating device 42, which includes a two-dimensional transfer device 421 for generating a horizontal coordinate X and a vertical coordinate Y; and an overflow detecting device 425 for generating an overflow signal when the pattern coordinate is greater than the boundary of the pattern.

Figure 5A:
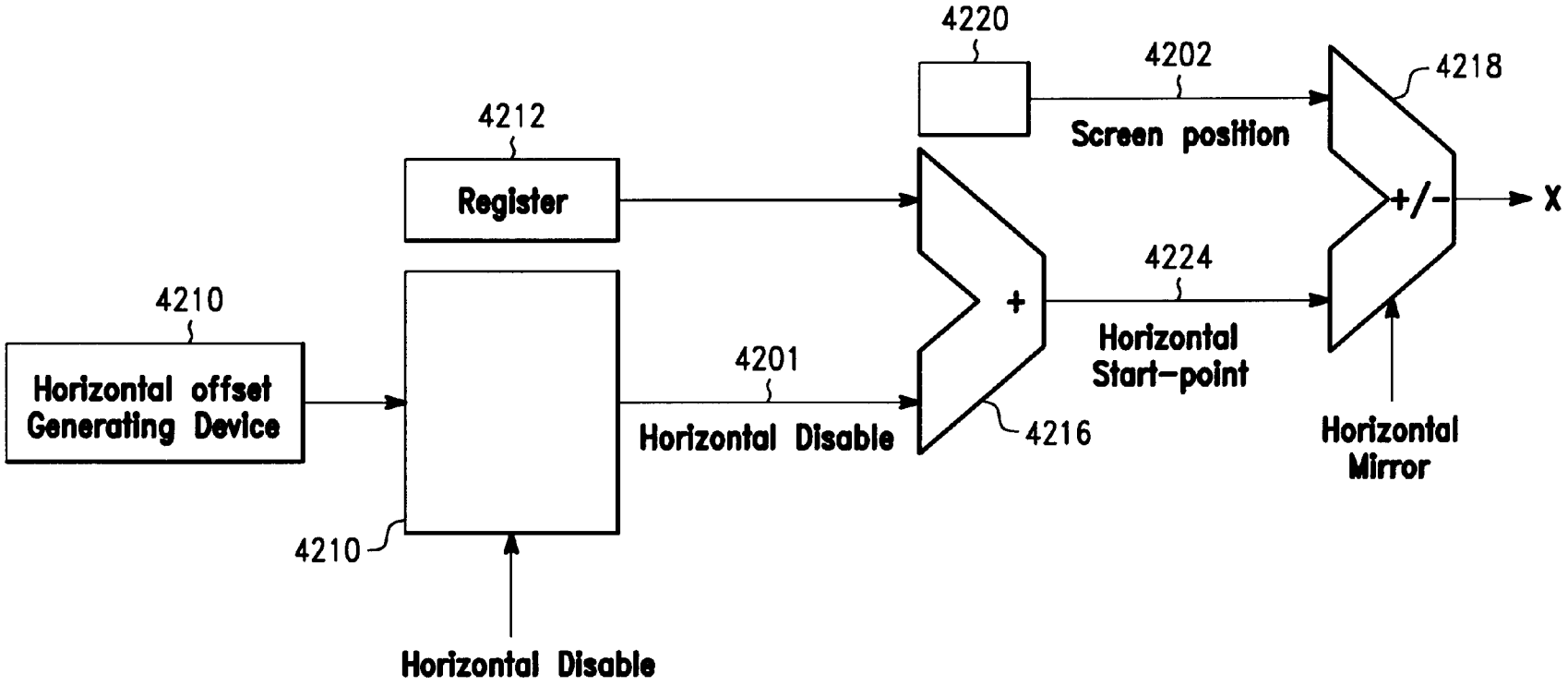
FIG. 5A shows the horizontal coordinate generating device of a two-dimensional transfer device.

FIG. 5A shows a detailed block diagram of the horizontal coordinate generating device in the two-dimensional transfer device 421. Data is written in a register device 4212 from a central processing unit (CPU), and a horizontal offset 4201 is generated by a horizontal offset generating device 4210. The data in the register device 4212 and the horizontal offset 4201 are added by an adder 4216 to generate a horizontal start-point 4224. A horizontal screen generating device 4220 generates a relative position 4202 of the screen scan to a screen, and a first adder 4218 adds the horizontal start-point 4224 and the relative position 4202 of the screen scan to generate the horizontal coordinate X.

Figure 5B:
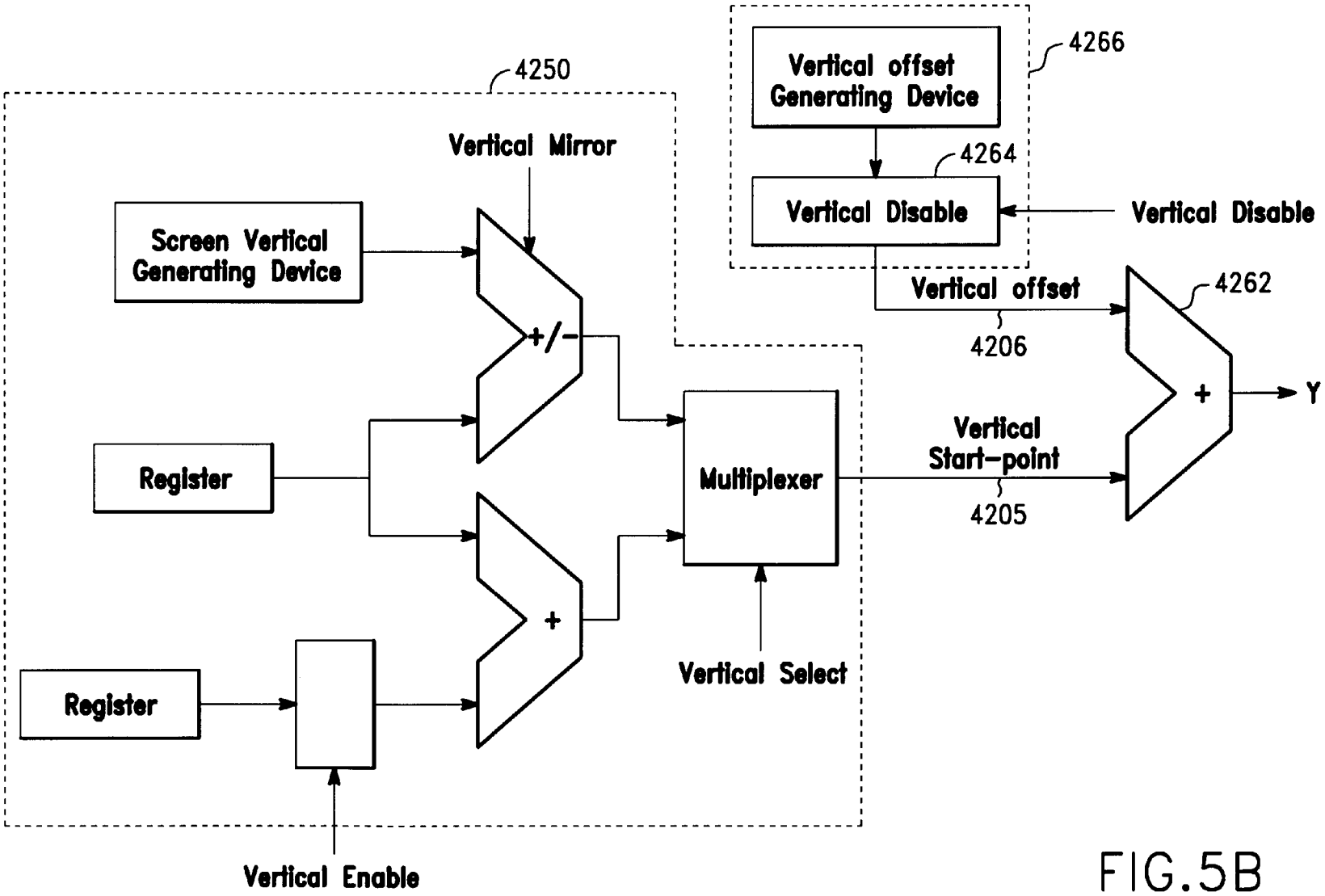
FIG. 5B shows the vertical coordinate generating device of the two-dimensional transfer device.

FIG. 5B shows a detailed block diagram of the vertical coordinate generating device in the two-dimensional transfer device 421. A vertical start-point generating device 4250 generates a vertical start-point 4205 corresponding to a screen scan, and a vertical offset device 4266 generates a vertical offset 4206. The vertical start-point 4205 and the vertical offset device 4266 are added by a second adder 4262 to generate the horizontal coordinate Y.

Figure 6A:
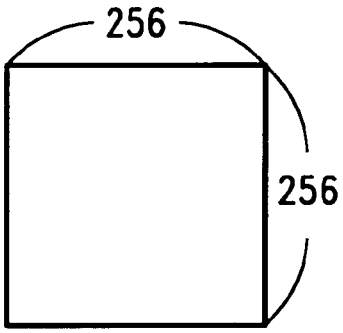
FIGS. 6A to 6B show the address format of the PNT for a pattern of 256×256 pixels.
Figure 6B:
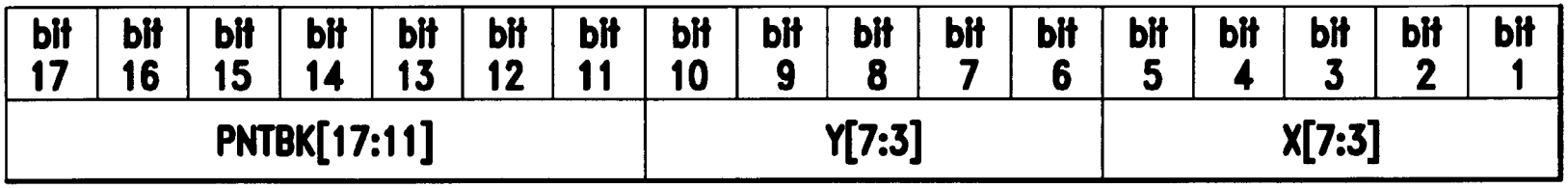
Figure 6C:
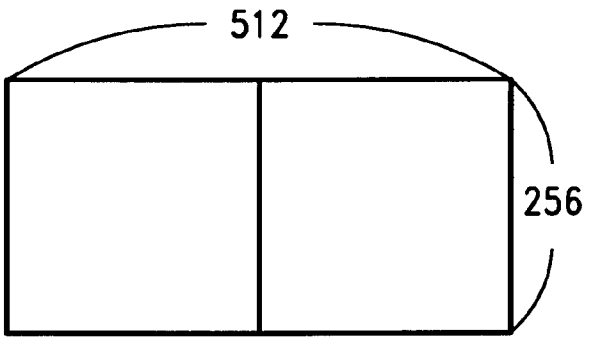
FIGS. 6C to 6D show the address format of the PNT for a pattern of 512×256 pixels.
Figure 6D:
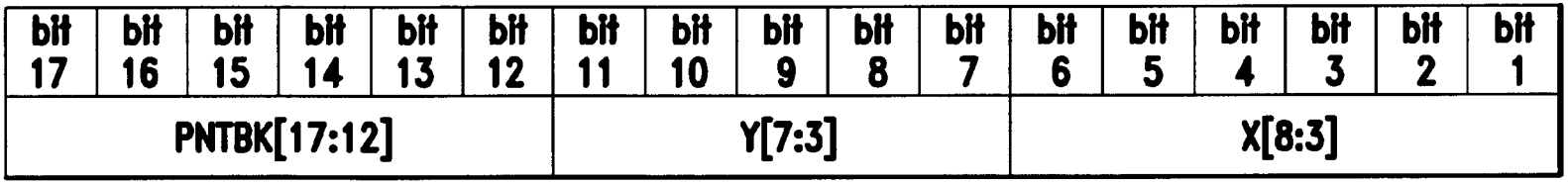
Figure 7:
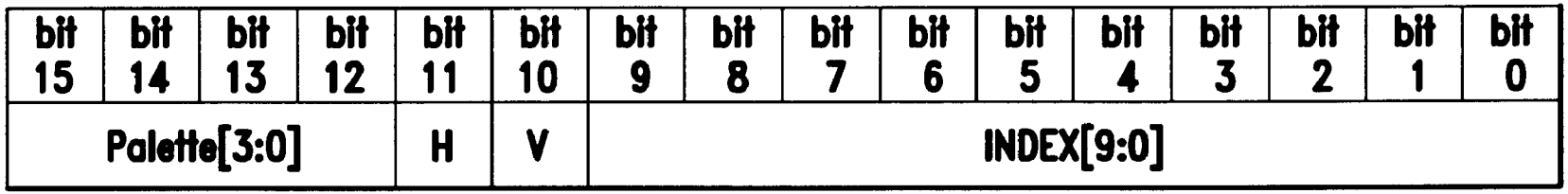
FIG. 7 is the format of the PNT according to the preferred embodiment of the present invention.

The pattern coordinate (X, Y) mentioned above is input to the index address generating device 431 of the index reading device 43 to generate an address, followed by reading the index data of the PNT from the memory device 41 through the data bus and and storing the index data into an index register device 435. As shown in FIGS. 6A to 6L, the index address is generated according to the coordinate (X,Y), a page size (PS) such as 256×256 pixels, and a font size (FS) such as a 8×8 image cell. FIG. 6B shows an address format (FIG. 6A) for a pattern having a page size of 256×256, and a font size of 8×8. In this format, the three least significant bits X[2:0] and Y[2:0] are not needed due to the fact that eight bits are read every time. A switching bank of the PNT (PNTBK) is used for slicing the memory into many PNT blocks, and thus accelerating the process by switching among these PNT blocks. FIGS. 6C to 6D show the address format for pattern of 512×256. All the address formats mentioned above use the corresponding format to read a PNT data from the memory device 41 and store the acquired data in an index register 435. The format of the PNT data is illustrated in FIG. 7. In this format, INDEX[9:0] is used to select one of 1024 ($2^{10}$) pattern generation table (PGT) data. Further, H and V in the format are a horizontal mirror control signal and a vertical mirror control signal respectively for replicating a symmetrical picture. Also, PALETTE [3:0] is used for increasing more available colors.

Figure 8A:
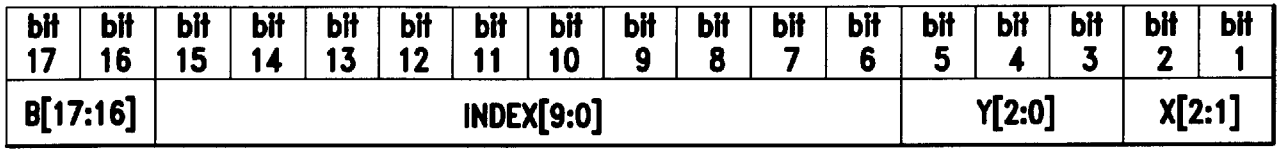
FIGS. 8A to 8B show the format of the PGT for a picture of 256 colors.
Figure 8B:
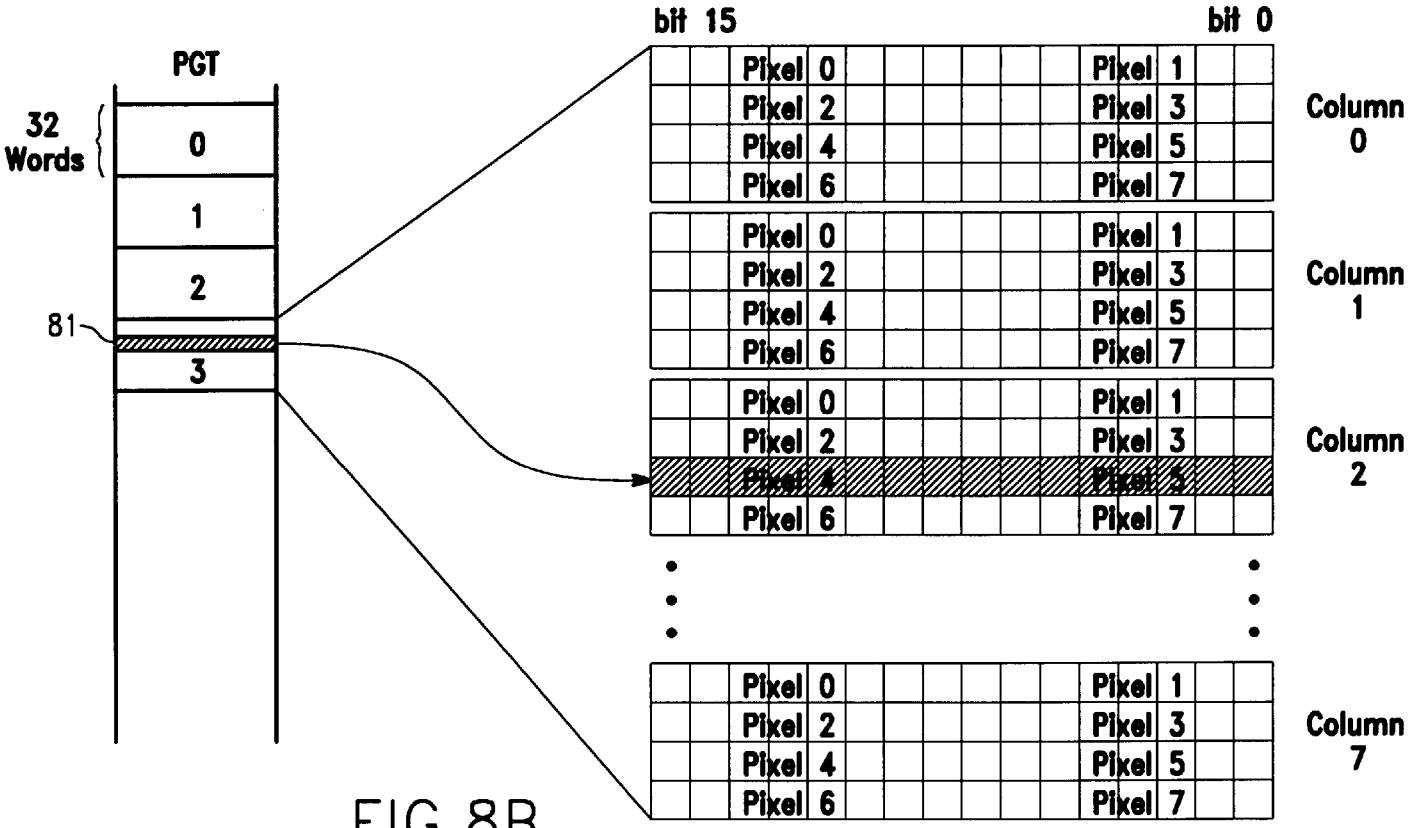
Figure 8C:
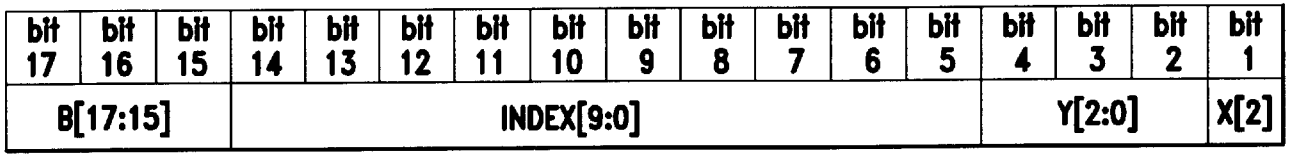
FIGS. 8C to 8D show the format of the PGT for a picture of 16 colors.
Figure 8D:
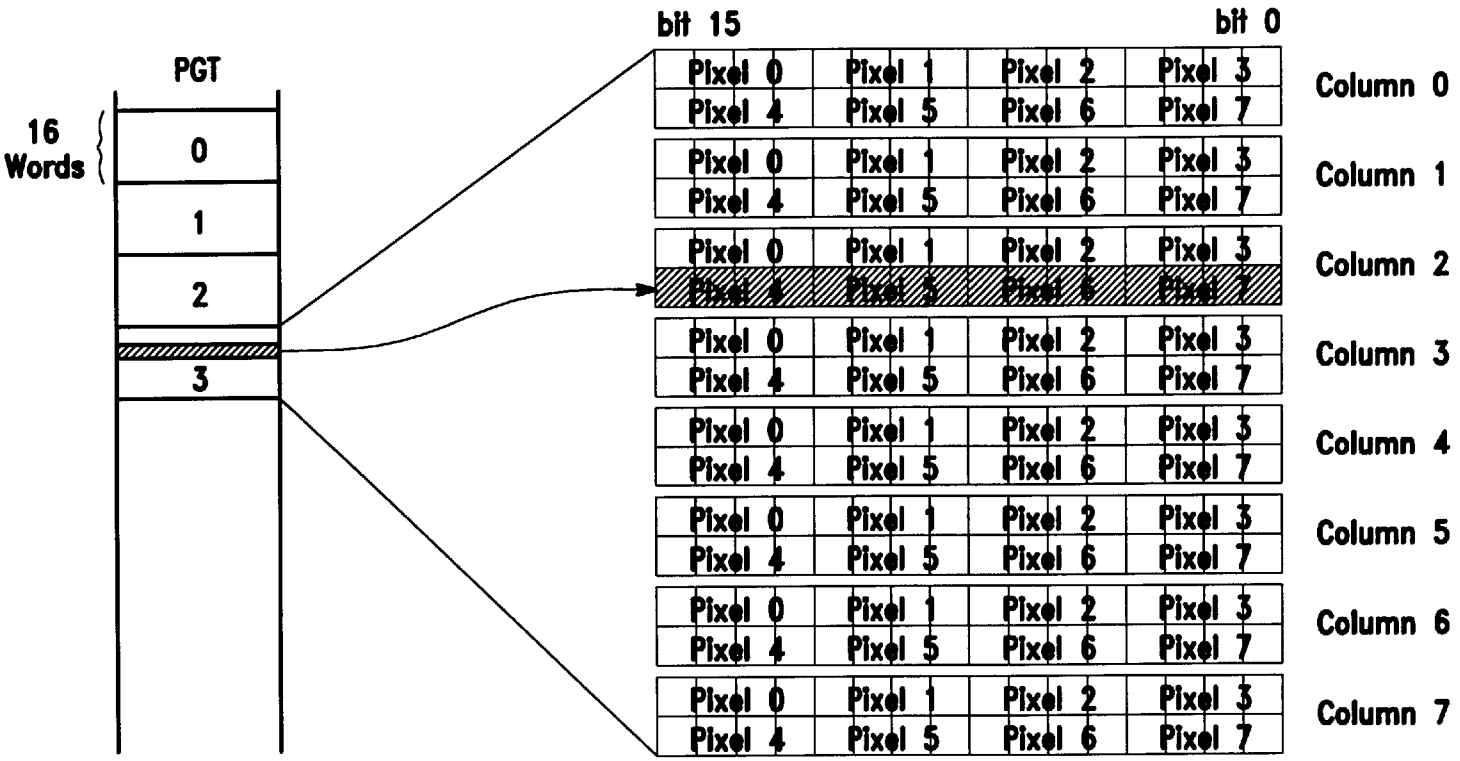
Figure 8E:
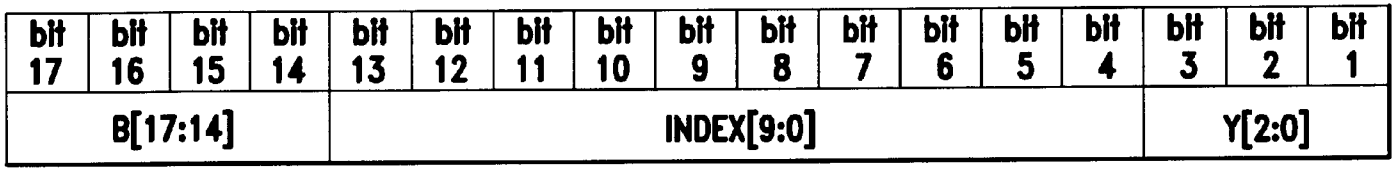
FIGS. 8E to 8F shows the format of the PGT for a picture of 4 colors.
Figure 8F:
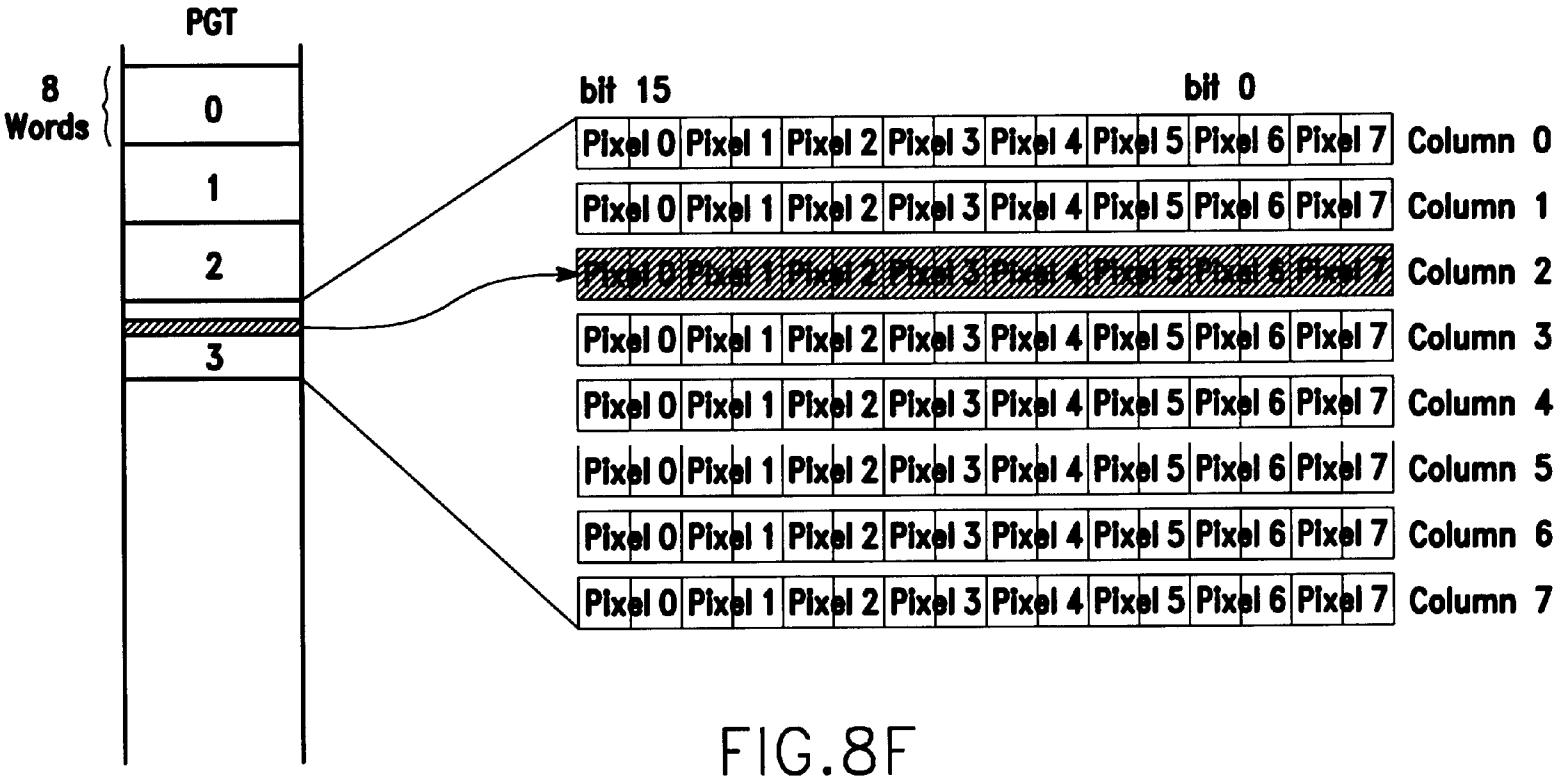
Figure 8G:
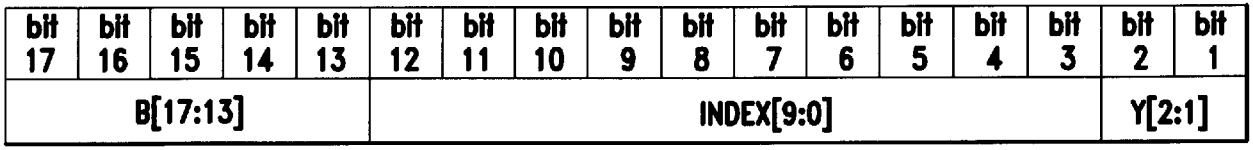
FIGS. 8G to 8H shows the format of the PGT for a picture of 2 colors.
Figure 8H:
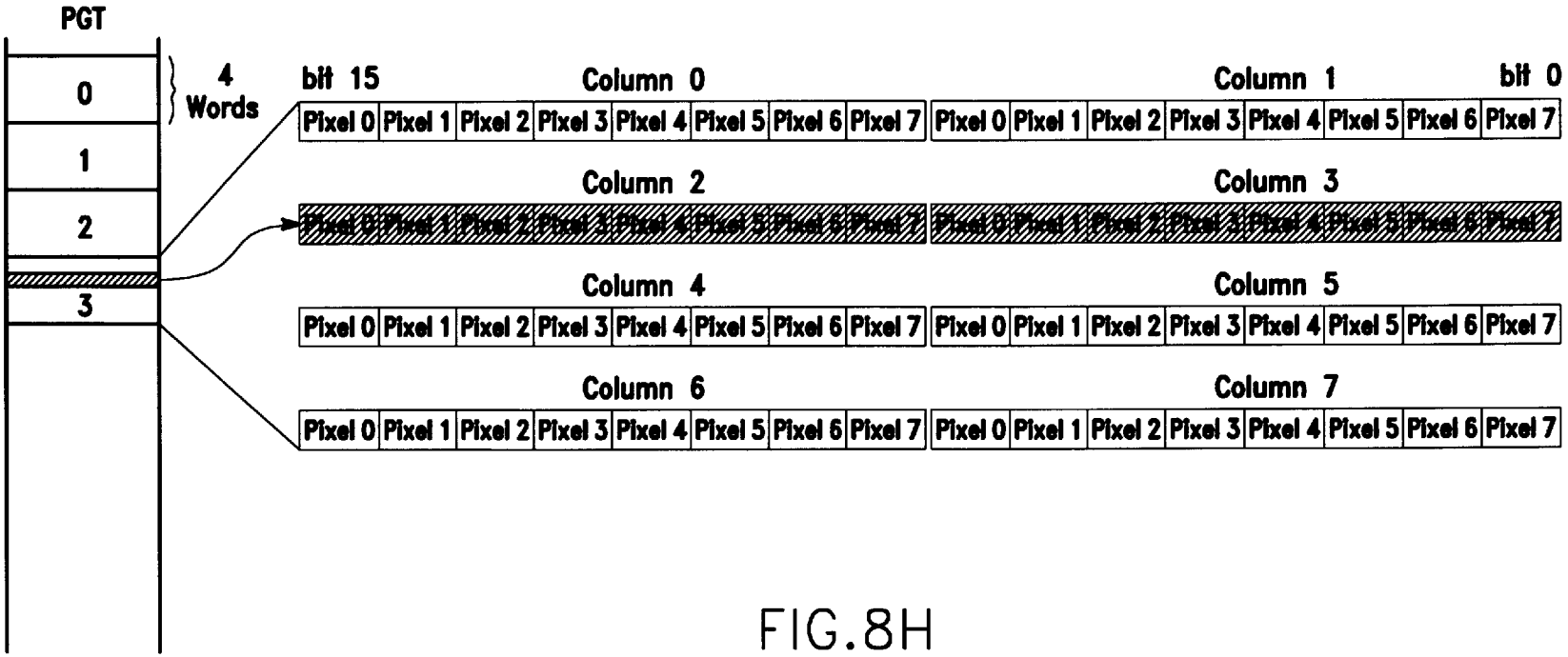

After the aforementioned page size (PS), index font size (FS), color mode (CM) and coordinate (X,Y) are collected, an address is generated from the pattern address generating device 441 inside the pattern reading device 41, followed by reading a pattern data from the memory device and storing the obtained data in the pattern register 445. FIGS. 8A to 8H show the address formats of the pattern address generating device 441 and the formats of the corresponding PGT for 256, 16, 4 and 2 colors. In FIG. 8A, the bit 0 of the x coordinate is not required because two bytes are read each time. As shown in FIG. 8B, for example, when the INDEX=3=0 . . . 011, x=4=100, y=2=010, then the pattern data 81 corresponds to the pixels 4 and 5 of column 2. FIGS. 8C to 8H are some examples for 16 colors, 4 colors and 2 colors respectively. The number of bytes for one image cell and the maximum number of pixels read in a time interval are listed in Table 3.

TABLE 3

| | | | | |
|---|---|---|---|---|
| number of colors | 256 | 16 | 4 | 2 |
| number of words | 32 | 16 | 8 | 4 |
| number of bytes | 64 | 32 | 16 | 8 |
| pixel per interval | 2 | 4 | 8 | 16 |

Figure 8I:
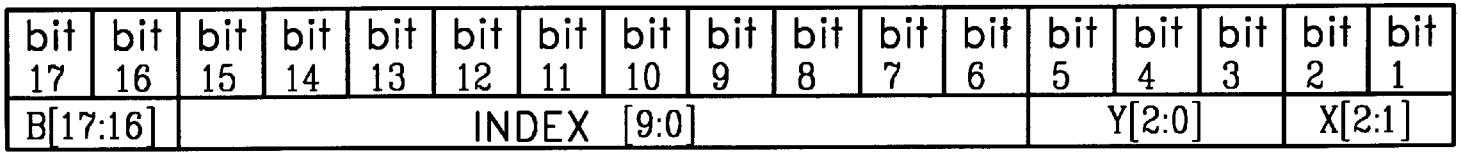
FIG. 8I shows the format of the PGT for a picture of 256 colors using a mosaic size of 2×2.
Figure 8J:
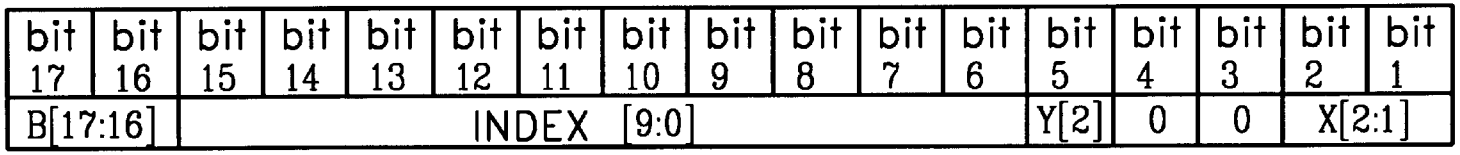
FIG. 8J shows the format of the PGT for a picture of 256 colors using a mosaic size of 4×4.
Figure 8K:
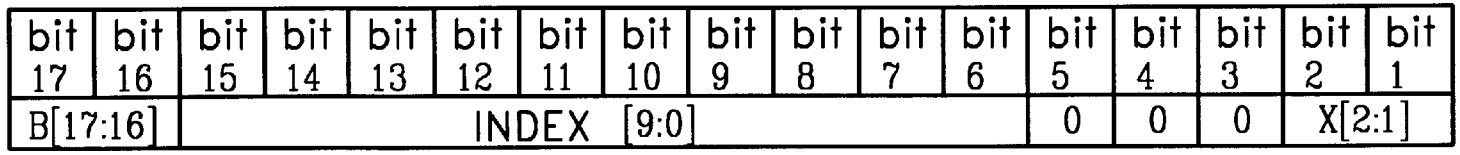
FIG. 8K shows the format of the PGT for a picture of 256 colors using a mosaic size of 8×8.

FIG. 8I shows another example of the address formats under 256 color-mode using a mosaic size of 2×2. The third bit is particularly set to 0, letting the column 0 to be read instead of reading column 1 as in the situation without mosaic process. The column 2 is read instead of reading the column 3. FIG. 8J shows an example of the address format under 256 color-mode using a mosaic size of 4×4. Both the third bit and the fourth bit are set to 0, letting the column 0 to be read four times instead of reading column 0, column 1, column 2 and column 3 as in the situation without mosaic process. An example of the address format under 256 color-mode using a mosaic size of 8×8 is further shown in FIG. 8K. As the third bit, fourth bit and fifth bit are set to 0, therefore the column 0 is read seven times instead of reading column 0 to column 7 as in the situation without mosaic process.

Figure 9A:
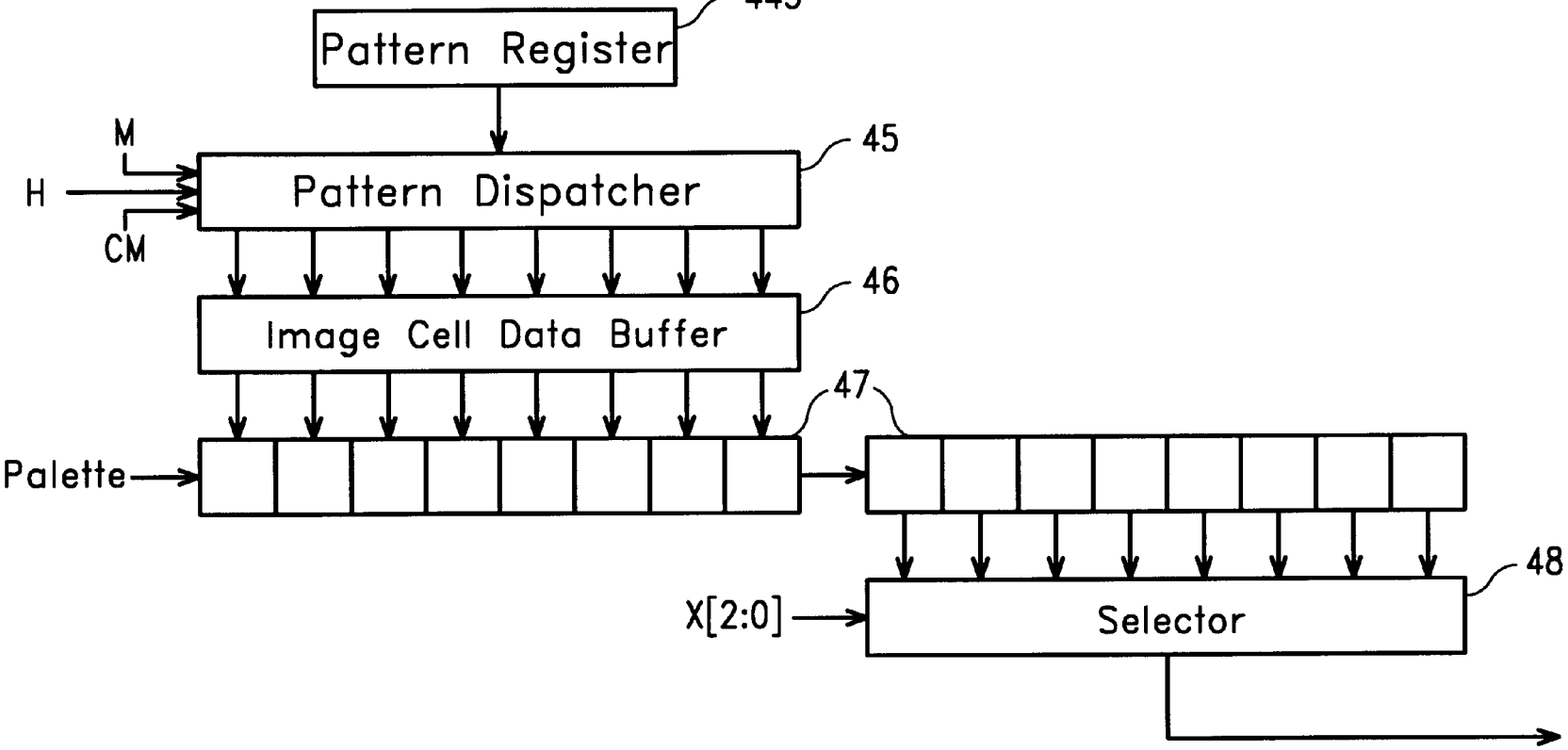
FIG. 9A shows the block diagram of the processing device of the PGT according to the present invention.
Figure 9B:
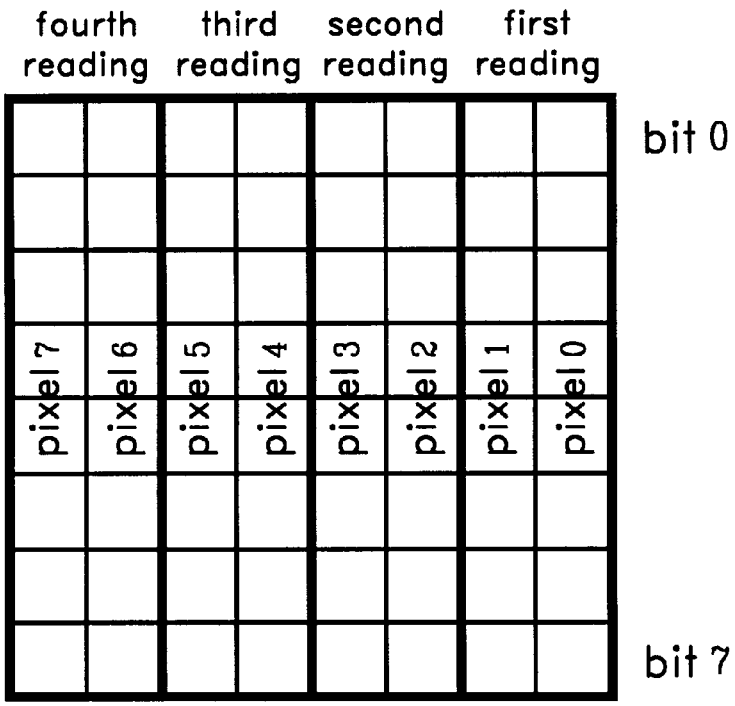
FIG. 9B demonstrates the storing scheme of an image cell buffer for a picture of 256 colors.
Figure 9C:
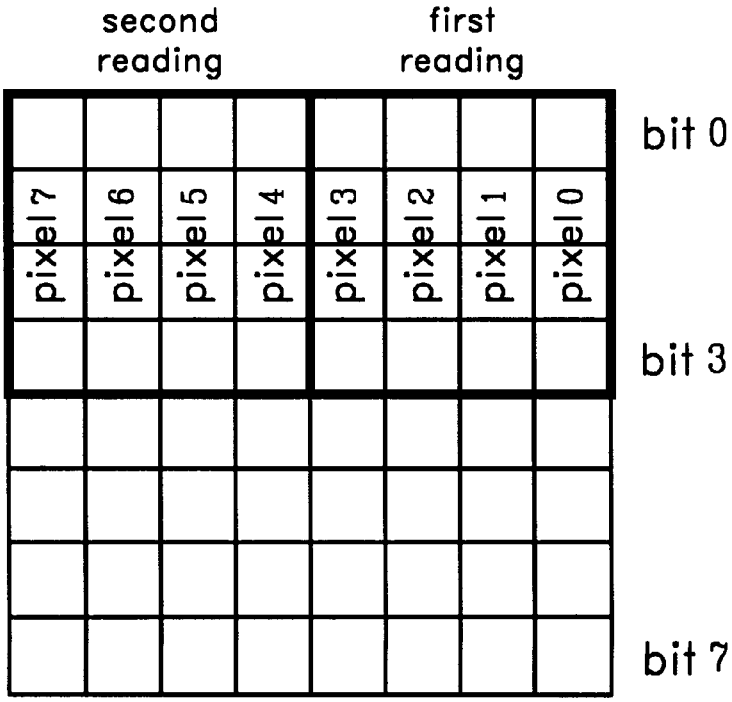
FIG. 9C demonstrates the storing scheme of an image cell buffer for a picture of 16 colors.
Figure 9D:
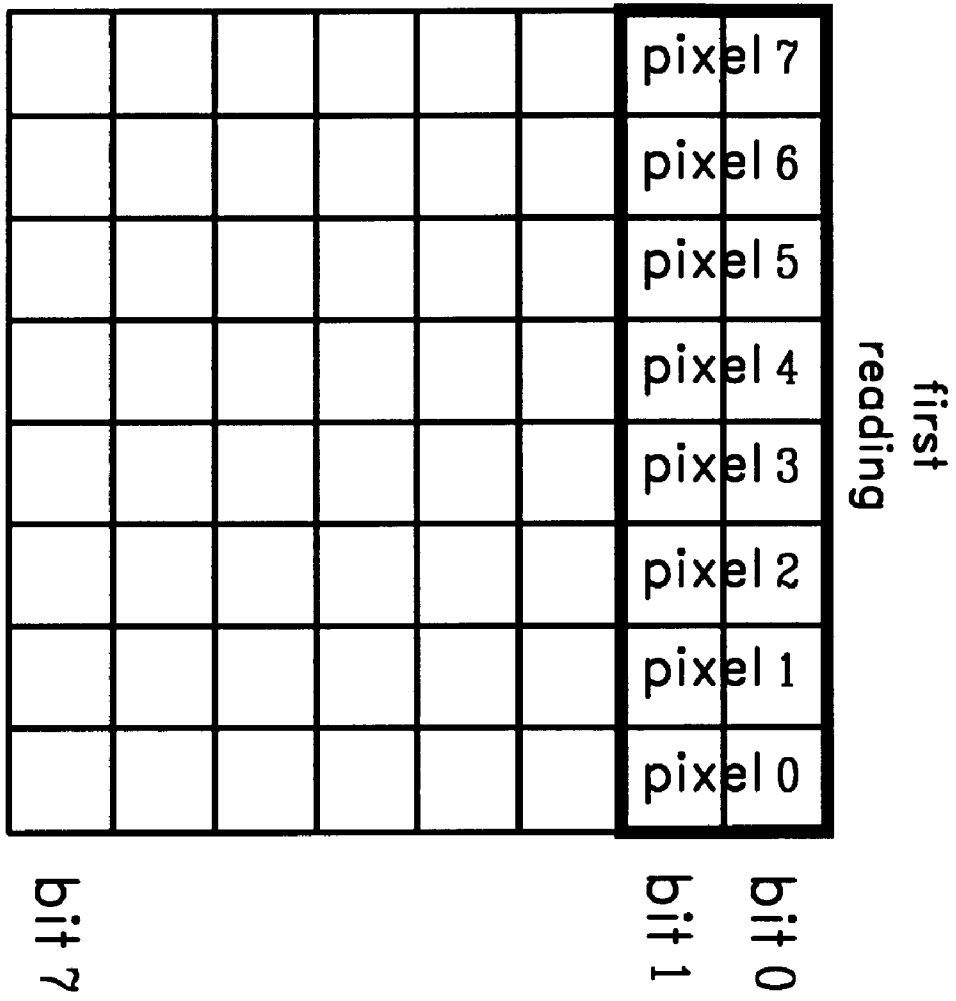
FIG. 9D demonstrates the storing scheme of an image cell buffer for a picture of 4 colors.

A shown in FIG. 9A, the pattern data from the pattern register 445, the horizontal mirror H and the color mode CM are fed to a pattern dispatching device 45 for dispatching the pattern data and then storing the data in an image cell data buffer 46. As shown in FIG. 9B, the pixels are stored in the image cell data buffer 46 after four readings for 256-color mode without mosaic process. In FIG. 9C, two readings are needed for 16-color mode without mosaic process. However, in FIG. 9D, only one reading is required for 4-color mode without mosaic process. Referring to FIG. 9A again, the data are fed in parallel to a shift register 47 and are responsive to the palette signal generating a serial output to a selecting device 48. The position of the serial output is selected by the least three significant bits X[2:0] to generate a color code.

Figure 10A:
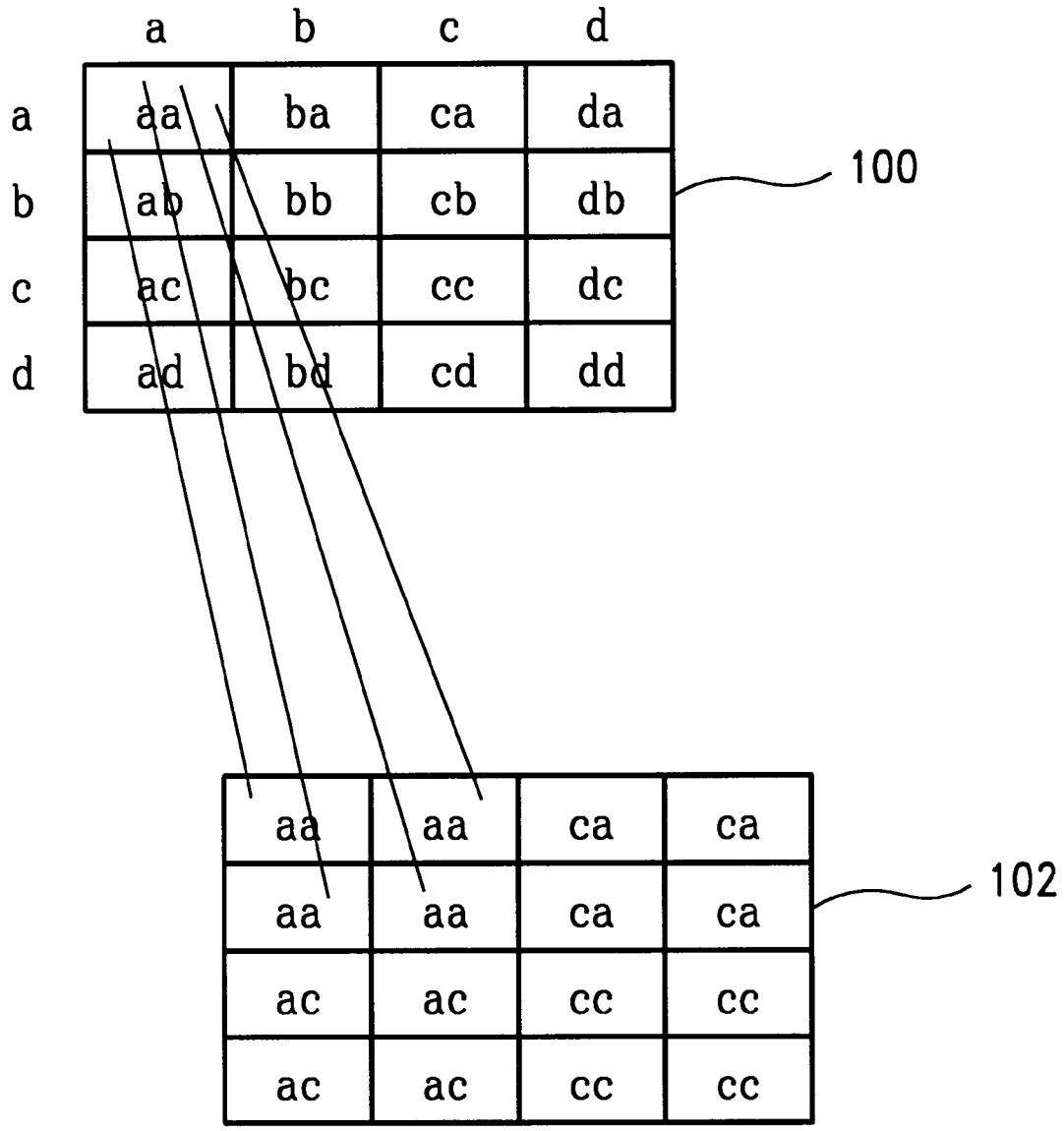
FIG. 10A shows a mapping example with a mosaic size of2×2.
Figure 10B:
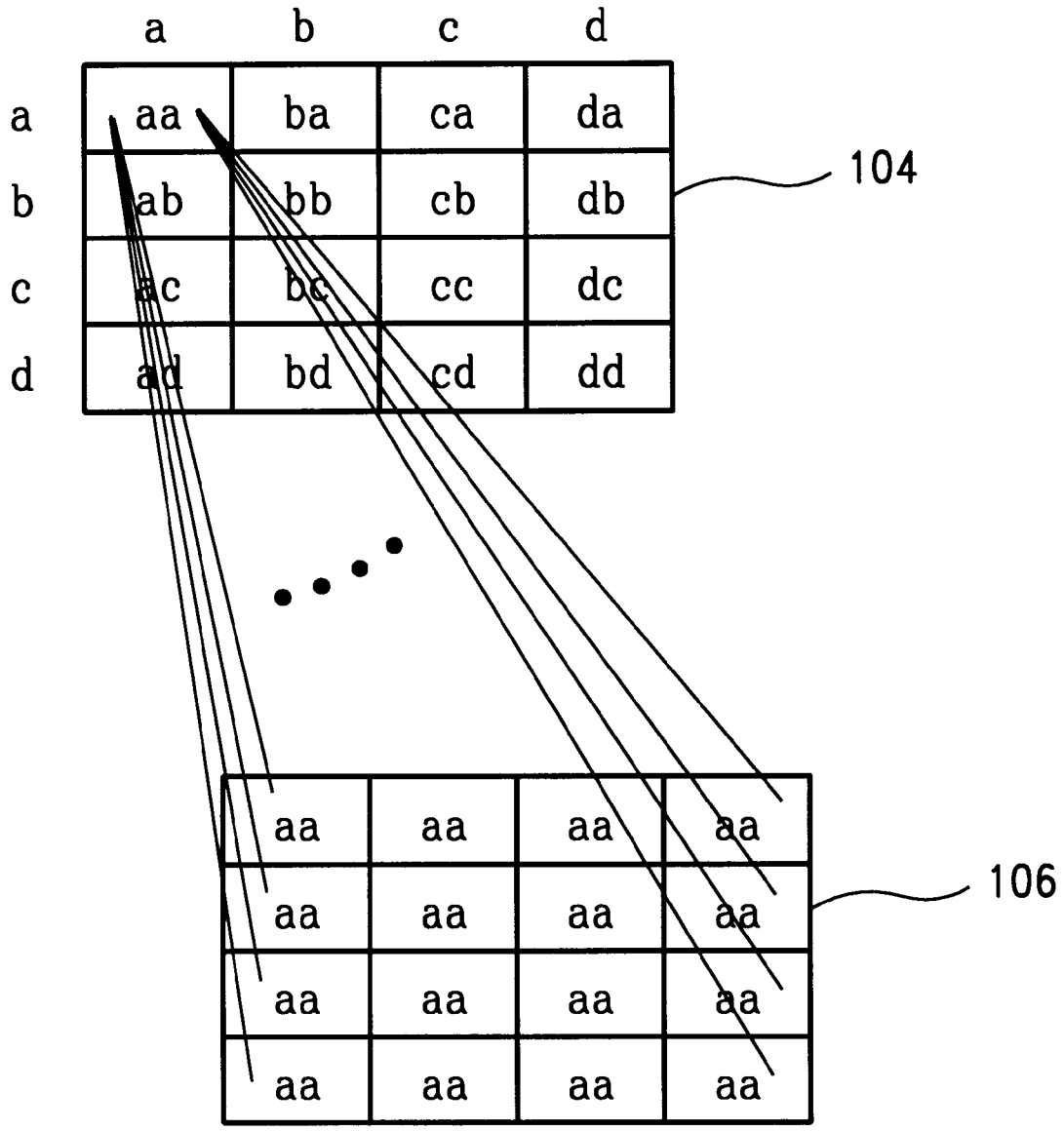
FIG. 10B shows a mapping example with a mosaic size of 4×4.
Figure 10D:
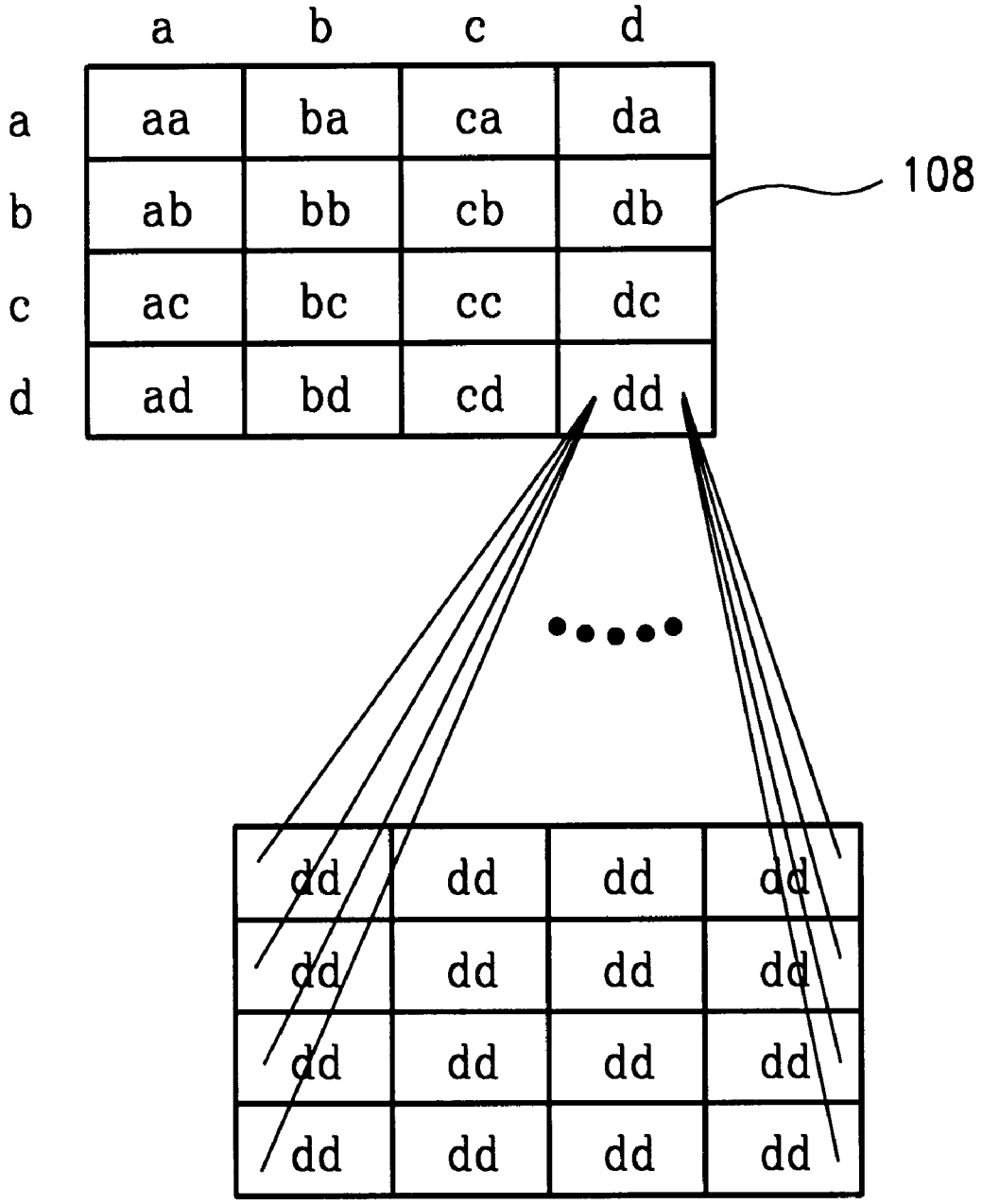
FIG. 10D shows another mapping example with a mosaic size of 4×4.

FIGS. 10A to 10D demonstrate four possible mapping examples using mosaic process. A mosaic having size of 2×2 is used in the example of FIG. 10A, where a lower picture 102 is mapped to an upper picture 100. As shown in this figure, all the 2×2 pixels are mapped to aa. The mapping in FIG. 10B uses a mosaic size of 4×4, and therefore all pixels of the lower picture 106 are mapped to the associated pixel as the pixel aa. FIG. 10C shows another example having a mosaic size of 2×2. The lower four pixels bb's are mapped to the upper bb, which differs slightly from the mapping shown in FIG. 10A. FIG. 10D shows another example having a mosaic size of 4×4. All pixels of the lower picture are mapped to the upper pixel dd.

Figure 11A:
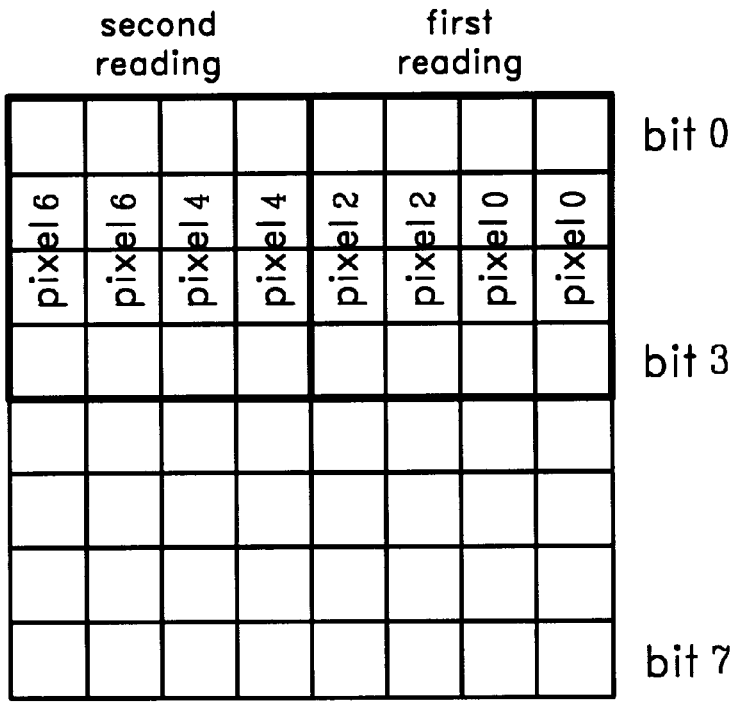
FIG. 11A demonstrates the storing scheme of an image cell buffer for a picture of 256 colors with a mosaic size of 2×2.
Figure 11B:
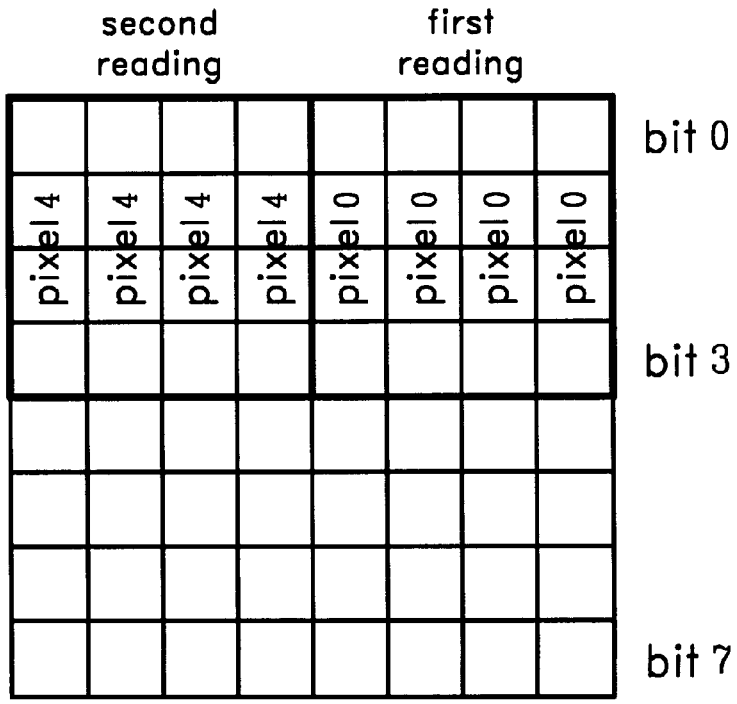
FIG. 11B demonstrates the storing scheme of an image cell buffer for a picture of 256 colors with a mosaic size of 4×4.
Figure 11C:
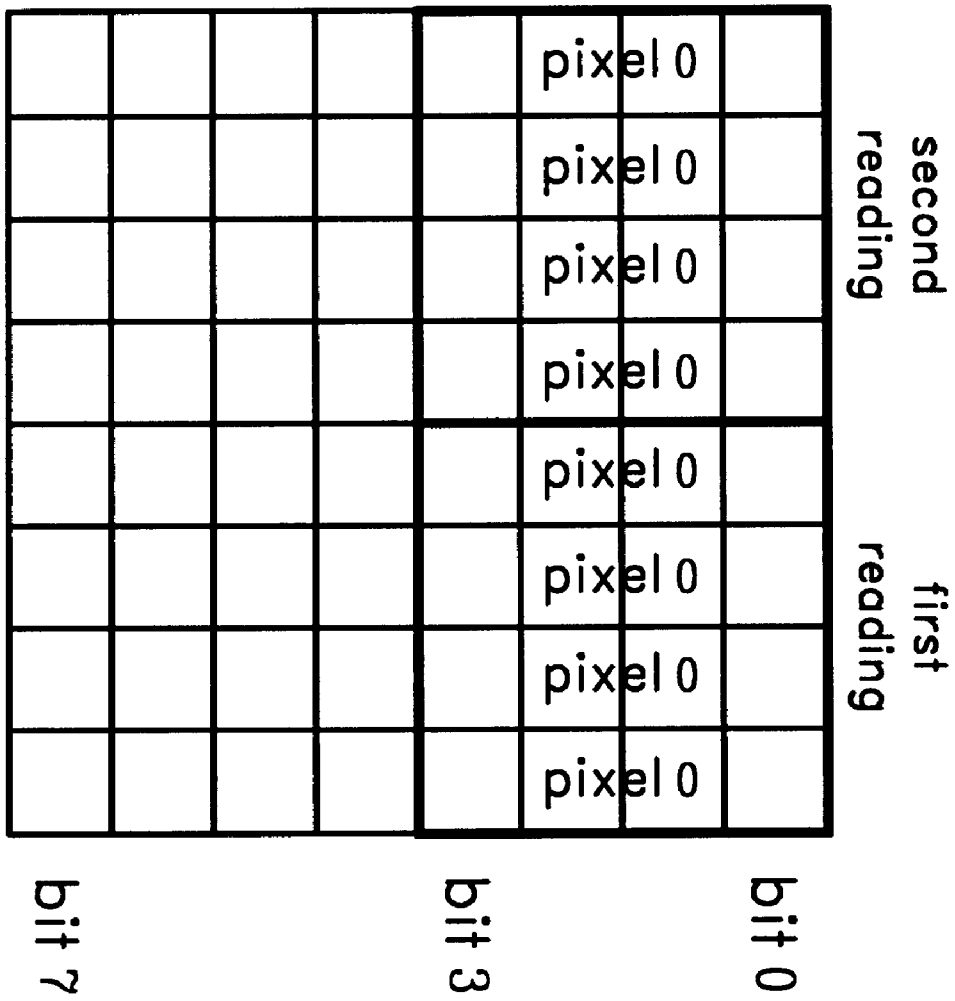
FIG. 11C demonstrates the storing scheme of an image cell buffer for a picture of 256 colors with a mosaic size of 8×8.

Referring back to FIG. 9C, two readings and four pixels per reading are required for accessing a whole column without mosaic process. On the contrary, the mosaic control signal M is input to the pattern dispatcher 45 for deciding the mosaic size, therefore filling all pixels on the same mosaic area with one color. For example, a 16-color mode in a mosaic size of 2×2 is shown in FIG. 11A, where the first two pixels are filled with the color of the pixel 0, and the following two pixels are filled with the color of the pixel 2. FIG. 11B shows an example of a 16-color mode in a mosaic size of 4×4, where the first four pixels are filled with the color of the pixel 0. FIG. 11C further shows an example of a 16-color mode in a mosaic size of 8×8, where all the pixels are filled with the color of the pixel 0.

Figure 12:
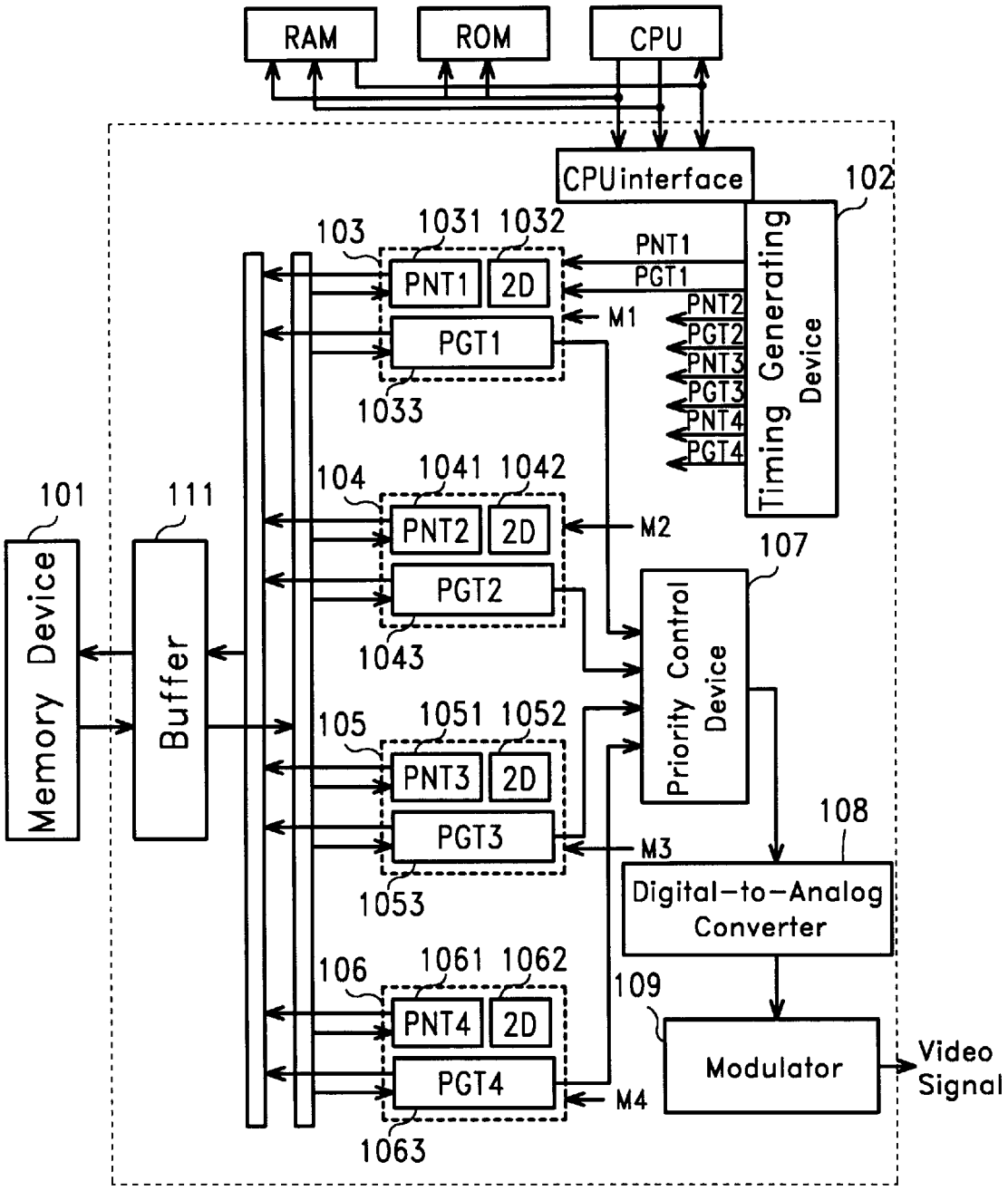
FIG. 12 shows the block diagram of the present invention.

FIG. 12 shows the block diagram of another preferred embodiment for a multi-layer picture processing system. A memory device 101 such as a static random access memory stores index data, pattern data and pattern control data for each layer. The timing of each layer is provided by a timing generating device 102. A mosaic device generates mosaic control signals M1, M2, M3 and M4 respectively for each layer. Four processing devices, i.e., a first processing device 103, a second processing device 104, a third processing device 105 and a fourth processing device 106, read the index data according to the timing, and then read the pattern data according to the acquired index data. Inside the first processing device 103 are a first index reading device 1031, a first pattern coordinate generating device 1032 and a first pattern reading device 1033; the second processing device 104 includes a second index reading device 1041, a second pattern coordinate generating device 1042 and a second pattern reading device 1043; the third processing device 105 includes a third index reading device 1051, a third pattern coordinate generating device 1052 and a third pattern reading device 1053; and the fourth processing device 106 includes a fourth index reading device 1061, a fourth pattern coordinate generating device 1062 and a fourth pattern reading device 1063. Furthermore, a priority control device 107 is used for selecting the pattern data of one layer of the processing device as an output by responding to a priority signal and a transparency signal. A digital-to-analog converter is further included for converting the output to an analog signal, which is then processed by a modulator 109, transferring the analog signal to a video signal. The mosaic technique can be applied to each layer independently through the mosaic control signals M1, M2, M3 and M4.

The steps of performing the multi-layer picture process are described in the following paragraphs. The content of the memory device 101 such as a video random access memory is configured for storing the pattern data, which are previously obtained by a program or stored in a read only memory. The pattern data include pattern name table (PNT) data, pattern generation table (PGT) data, and the pattern control data such as a horizontal offset and a vertical offset.

Next, the processing devices 103, 104, 105 and 106 are controlled by the timing generated by the timing generating device 102, and therefore generates an index address for reading the PNT. The pattern reading devices 1033, 1043, 1053 and 1063 are used to read the pattern. Finally, the priority control device 107 receives priority signals and transparency control signals of all layers to select the pattern data of one of the four layers as an output.

The present invention is controlled by the optimum timing control 102, which is capable of processing 256 colors for the first processing device 103, 16 colors for the second processing device 104, 4 colors for the third processing device 105, and 4 colors for the fourth processing device 106. Some possible combinations of the timing are demonstrated in FIGS. 13A to 13C. The mode shown in FIG. 13A is referred to as 4-4-4-4 mode for processing four layers each having 4 colors, where the PNT and the PGT are read in intervals P0 and P1. The intervals P2 and P3 are for the second layer, the intervals P4 and P5 are for the third layer, and the intervals P6 and P7 are for the fourth layer. Referring to the pattern data format of FIG. 8E, the bandwidth usage is 100% for this mode.

The mode shown in FIG. 13B is referred to as 16-16-4 mode for processing three layers respectively having 16, 16 and 4 colors. According to FIG. 8D, two readings are required to obtain a column of eight pixels. Thereafter, two PGTs follow each PNT, i.e., PNT1 and PNT 2. Further, the two remaining intervals are used for reading a column of 4 colors.

The mode shown in FIG. 13C is referred to as 256-16 mode for processing two layers respectively having 256 and 16 colors. According to FIG. 8B, four intervals are needed for reading a column of 256 colors. All possible combinations mentioned in FIGS. 13A to 13C have 100% bandwidth usage. Table 4 below lists the number of colors in each mode, where the rightmost column illustrates the optimum combination.

TABLE 4

| | 4-4-4-4 | 16-16-4 | 256-16 | |
|---|---|---|---|---|
| first layer | 4 | 16 | 256 | 256/16/4/2 |
| second layer | 4 | 16 | 16 | 16/4/2 |
| third layer | 4 | 4 | | 4/2 |
| fourth layer | 4 | | | 4/2 |

Although specific embodiments have been illustrated and described it will be obvious to those skilled in the art that various modification may be made without departing from the spirit which is intended to be limited solely by the appended claims.

What is claimed is:

1. A mosaic multi-layer picture processing apparatus, comprising:

memory means for storing a plurality of index data, a plurality of pattern data and a plurality of pattern control data;

timing generating means for generating a plurality of timing signals for each of a plurality of layers;

processing means responsive to said plurality of timing signals for reading the index data and reading the pattern data, said timing signals controlling a reading sequence of the index data and the pattern data depending on a number of said layers;

means for generating a plurality of mosaic control signals to control said processing means; and priority control means responsive to a priority signal and a transparency signal for selecting one layer of said processing means.

2. The apparatus according to claim 1, wherein said memory means comprises a static random access memory.

3. The apparatus according to claim 1, wherein said processing means comprises:

pattern coordinate generating means for generating a horizontal coordinate and a vertical coordinate;

index means responsive to the horizontal coordinate, the vertical coordinate and the mosaic control signal for reading the index data from said memory means;

pattern means responsive to the horizontal coordinate, the vertical coordinate, the index data and the mosaic control signal for reading the pattern data from said memory means.

4. The apparatus according to claim 3, wherein said pattern coordinate generating means comprises:

horizontal coordinate generating means for generating the horizontal coordinate; and vertical coordinate generating means for generating the vertical coordinate.

5. The apparatus according to claim 4, wherein said horizontal coordinate generating means comprises:

horizontal start-point generating means for generating a horizontal start-point corresponding to a screen scan;

horizontal screen generating means for generating a relative position of the screen scan to a screen; and first adding means for adding the horizontal start-point and the relative position of the screen scan to generate the horizontal coordinate.

6. The apparatus according to claim 4, wherein said vertical coordinate generating means comprises:

vertical start-point generating means for generating a vertical start-point corresponding to a screen scan;

vertical offset means for generating a vertical offset; and second adding means for adding the vertical start-point and the vertical offset to generate the vertical coordinate.

7. The apparatus according to claim 3, wherein said index means comprises:

index address generating means for generating an index address, said index address being used to read the index data from said memory means; and index register means for storing the index data.

8. The apparatus according to claim 3, wherein said pattern means comprises:

pattern address generating means for generating a pattern address, said pattern address being used to read the pattern data from said memory means; and pattern register means for storing the pattern data.

9. A mosaic multi-layer picture processing apparatus, comprising:

memory means for storing a plurality of index data, a plurality of pattern data and a plurality of pattern control data;

timing generating means for generating a plurality of timing signals for each of a plurality of layers;

processing means responsive to said plurality of timing signals for reading the index data and reading the pattern data, said timing signals controlling a reading sequence of the index data and the pattern data to read the index data for one time and the pattern data for at least one time to achieve a full usage of a processing bandwidth;

means for generating a plurality of mosaic control signals to control said processing means; and priority control means responsive to a priority signal and a transparency signal for selecting one layer of said processing means.

10. The apparatus according to claim 9, wherein said memory means comprises a static random access memory.

11. The apparatus according to claim 9, wherein said processing means comprises:

pattern coordinate generating means for generating a horizontal coordinate and a vertical coordinate;

index means responsive to the horizontal coordinate, the vertical coordinate and the mosaic control signal for reading the index data from said memory means; and pattern means responsive to the horizontal coordinate, the vertical coordinate, the index data and the mosaic control signal for reading the pattern data from said memory means.

12. The apparatus according to claim 11, wherein said pattern coordinate generating means comprises:

horizontal coordinate generating means for generating the horizontal coordinate; and vertical coordinate generating means for generating the vertical coordinate.

13. The apparatus according to claim 12, wherein said horizontal coordinate generating means comprises:

horizontal start-point generating means for generating a horizontal start-point corresponding to a screen scan;

horizontal screen generating means for generating a relative position of the screen scan to a screen; and first adding means for adding the horizontal start-point and the relative position of the screen scan to generate the horizontal coordinate.

14. The apparatus according to claim 12, wherein said vertical coordinate generating means comprises:

vertical start-point generating means for generating a vertical start-point corresponding to a screen scan;

vertical offset means for generating a vertical offset; and second adding means for adding the vertical start-point and the vertical offset to generate the vertical coordinate.

15. The apparatus according to claim 11, wherein said index means comprises:

index address generating means for generating an index address, said index address being used to read the index data from said memory means; and index register means for storing the index data.

16. The apparatus according to claim 11, wherein said pattern means comprises:

pattern address generating means for generating a pattern address, said pattern address being used to read the pattern data from said memory means; and pattern register means for storing the pattern data.

17. A mosaic multi-layer picture processing apparatus, comprising:

memory means for storing a plurality of index data, a plurality of pattern data and a plurality of pattern control data;

timing generating means for generating a plurality of timing signals for each of a plurality of layers;

processing means responsive to said plurality of timing signals for reading the index data and reading the pattern data, said timing signals controlling a reading sequence of the index data and the pattern data to read the index data for one time and the pattern data for at least one time, a number of times of reading the pattern data after each reading of the index data depending on a number of colors of the pattern data;

means for generating a plurality of mosaic control signals to control said processing means; and priority control means responsive to a priority signal and a transparency signal for selecting one layer of said processing means.

18. The apparatus according to claim 17, wherein said memory means comprises a static random access memory.

19. The apparatus according to claim 17, wherein said processing means comprises:

pattern coordinate generating means for generating a horizontal coordinate and a vertical coordinate;

index means responsive to the horizontal coordinate, the vertical coordinate and the mosaic control signal for reading the index data from said memory means; and pattern means responsive to the horizontal coordinate, the vertical coordinate, the index data and the mosaic control signal for reading the pattern data from said memory means.

20. The apparatus according to claim 19, wherein said pattern coordinate generating means comprises:

horizontal coordinate generating means for generating the horizontal coordinate; and vertical coordinate generating means for generating the vertical coordinate.

21. The apparatus according to claim 20, wherein said horizontal coordinate generating means comprises:

horizontal start-point generating means for generating a horizontal start-point corresponding to a screen scan;

horizontal screen generating means for generating a relative position of the screen scan to a screen; and first adding means for adding the horizontal start-point and the relative position of the screen scan to generate the horizontal coordinate.

22. The apparatus according to claim 20, wherein said vertical coordinate generating means comprises:

vertical start-point generating means for generating a vertical start-point corresponding to a screen scan;

vertical offset means for generating a vertical offset; and second adding means for adding the vertical start-point and the vertical offset to generate the vertical coordinate.

23. The apparatus according to claim 19, wherein said index means comprises:

index address generating means for generating an index address, said index address being used to read the index data from said memory means; and index register means for storing the index data.

24. The apparatus according to claim 19, wherein said pattern means comprises:

pattern address generating means for generating a pattern address, said pattern address being used to read the pattern data from said memory means; and pattern register means for storing the pattern data.

* * * * *